US008562309B2

(12) United States Patent
Sato et al.

(10) Patent No.: US 8,562,309 B2
(45) Date of Patent: Oct. 22, 2013

(54) PISTON COMPRESSOR

(75) Inventors: Shinichi Sato, Aichi-ken (JP); Manabu Sugiura, Aichi-ken (JP); Toshiyuki Kobayashi, Aichi-ken (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 269 days.

(21) Appl. No.: 12/686,127

(22) Filed: Jan. 12, 2010

(65) Prior Publication Data

US 2010/0178178 A1 Jul. 15, 2010

(30) Foreign Application Priority Data

Jan. 14, 2009 (JP) ..... 2009-006027

(51) Int. Cl.
*F04B 1/12* (2006.01)
*F04B 27/08* (2006.01)

(52) U.S. Cl.
USPC ..... 417/269; 417/516; 184/6.17

(58) Field of Classification Search
USPC ..... 417/269, 516; 184/6.17; 91/153, 154; 92/71
See application file for complete search history.

(56) References Cited

U.S. PATENT DOCUMENTS

| | | | | |
|---|---|---|---|---|
| 4,596,518 | A * | 6/1986 | Sumikawa | 417/269 |
| 4,974,702 | A * | 12/1990 | Yokomachi et al. | 184/6.17 |
| 4,990,064 | A * | 2/1991 | Ikeda et al. | 417/269 |
| 6,988,875 | B2 * | 1/2006 | Shintoku et al. | 417/269 |
| 7,070,333 | B2 * | 7/2006 | Ito et al. | 384/473 |
| 7,547,198 | B2 * | 6/2009 | Saiki et al. | 417/269 |
| 7,841,840 | B2 * | 11/2010 | Sato et al. | 417/269 |
| 8,047,810 | B2 * | 11/2011 | Sugiura et al. | 417/269 |
| 2008/0226483 | A1 * | 9/2008 | Iwanami et al. | 418/97 |
| 2009/0028722 | A1 * | 1/2009 | Hirose | 417/269 |
| 2010/0189576 | A1 * | 7/2010 | Sato et al. | 417/269 |

FOREIGN PATENT DOCUMENTS

| | | |
|---|---|---|
| JP | 54-80108 | 7/1979 |
| JP | 1-162088 | 10/1989 |
| JP | 2-101080 | 10/1990 |
| JP | 07-317655 | 12/1995 |
| JP | 2003-247488 | 9/2002 |
| JP | 2003-172253 | 6/2003 |
| JP | 2007-002853 | 1/2007 |
| JP | 2007-270790 | 10/2007 |

* cited by examiner

*Primary Examiner* — Peter J Bertheaud
*Assistant Examiner* — Christopher Maxey
(74) *Attorney, Agent, or Firm* — Woodcock Washburn LLP

(57) ABSTRACT

A compressor includes a rotary shaft, a cam, a cylinder block, pistons, a thrust bearing, a rotary valve, and an oil passage. The rotary shaft has an in-shaft passage formed therein. The cam rotates integrally with the rotary shaft. The pistons are coupled to the rotary shaft through the cam. The thrust bearing is provided between the cam and the cylinder block. The thrust bearing includes a first race in contact with the cam, a second race in contact with the cylinder block, and rolling elements retained between the first and second races to form a gap therebetween. The oil passage extends from the gap to the in-shaft passage and includes an oil retaining space formed in at least one of the cam and the cylinder block.

7 Claims, 10 Drawing Sheets

PISTON COMPRESSOR

CROSS REFERENCE TO RELATED APPLICATION

This application claims priority to Japanese application number 2009-006027 filed Jan. 14, 2009.

BACKGROUND OF THE INVENTION

The present invention relates to a piston compressor with a lubrication mechanism, which includes a rotary valve rotated integrally with a rotary shaft and having a supply passage for introducing refrigerant from suction-pressure region of the compressor into a compression chamber defined in a cylinder bore by a piston.

A conventional piston type compressor using a rotary valve is disclosed in Japanese Unexamined Patent Application Publication No. 2003-247488. The compressor has a double-headed piston accommodated in paired front and rear cylinder bores of front and rear cylinder blocks, respectively. The piston forms compression chambers in the respective front and rear cylinder bores. The piston is reciprocated in the paired cylinder bores with the rotation of a swash plate rotating integrally with a rotary shaft of the compressor.

The rotary shaft is formed integrally with front and rear rotary valves. The rotary shaft has an in-shaft passage formed therein. The in-shaft passage has two outlets that form a part of the respective front and rear rotary valves. Each of the front and rear cylinder blocks is formed with suction ports that communicate with the respective compression chambers. The outlets of the in-shaft passage are intermittently communicable with the associated suction ports, with the rotation of the rotary shaft, that is, the rotation of the rotary valve. When the outlet of the in-shaft passage communicates with the suction port, refrigerant in the in-shaft passage is introduced into the compression chamber.

The in-shaft passage communicates with a suction chamber that is formed in a rear housing of the compressor. Refrigerant in the suction chamber is introduced through the in-shaft passage into the compression chambers in the respective front and rear cylinder bores. Refrigerant in the compression chamber of the front cylinder bore is discharged into a discharge chamber formed in a front housing of the compressor while pushing open a discharge valve. Refrigerant in the compression chamber of the rear cylinder bore is discharged into a discharge chamber formed in the rear housing while pushing open a discharge valve.

The compressor has a front thrust bearing interposed between the swash plate and the front cylinder block, and a rear thrust bearing interposed between the swash plate and the rear cylinder block. The position of the swash plate is restricted between the front and rear cylinder blocks by the front and rear thrust bearings.

The rotary shaft has an oil hole and a pressure-relief hole formed therein, and these holes extend between the outer peripheral surface of the rotary shaft and the in-shaft passage. The in-shaft passage includes a small-diameter portion and a large-diameter portion on the front and rear sides thereof, respectively. The in-shaft passage further includes a step located at the boundary between the small diameter portion and the large diameter portion and facing the rear thrust bearing. The oil hole is located upstream of the step as viewed in refrigerant flowing direction, in facing relation to the rear thrust bearing. The pressure relief-hole is located at a position facing the front thrust bearing.

Part of refrigerant flowing into the in-shaft passage from the suction chamber impinges on the step, so that lubricating oil contained in the refrigerant is separated. Part of such lubricating oil is delivered through the oil hole into the rear thrust bearing by centrifugal force caused by the rotation of the rotary shaft, so that the rear thrust bearing is lubricated. When the pressure of the crank chamber accommodating therein the swash plate is increased, refrigerant existing in the crank chamber is delivered through the pressure-relief hole into the in-shaft passage, so that the front thrust bearing is lubricated by lubricating oil contained in such refrigerant.

In the above-described compressor, however, since flow path extending through the front thrust bearing and the pressure-relief hole is straight, lubricating oil contained in the refrigerant flowing in such flow path is not separated sufficiently. Therefore, the lubrication of the front thrust bearing located adjacent to the pressure-relief hole may not be sufficient.

The present invention is directed to an improved lubrication of a thrust bearing in a piston compressor.

SUMMARY OF THE INVENTION

In accordance with an aspect of the present invention, a piston compressor includes a rotary shaft, a cam, a cylinder block, pistons, a thrust bearing, a rotary valve, and an oil passage. The rotary shaft has an in-shaft passage formed therein. The cam rotates integrally with the rotary shaft and is accommodated in a cam chamber. The cylinder block has a plurality of cylinder bores located around the rotary shaft. The pistons are accommodated in the respective cylinder bores to form therein compression chambers. The pistons are coupled to the rotary shaft through the cam so that rotating motion of the rotary shaft is transmitted to the pistons. The thrust bearing is provided between the cam and the cylinder block. The thrust bearing includes a first race in contact with the cam, a second race in contact with the cylinder block, and rolling elements retained between the first and second races to form a gap therebetween. The rotary valve is provided for introducing refrigerant into the compression chambers. The rotary valve includes the in-shaft passage of the rotary shaft. The refrigerant is introduced into the compressor and then delivered through the in-shaft passage to the compression chambers without passing through the cam chamber. The oil passage extends from the gap to the in-shaft passage. The oil passage includes an oil retaining space formed in at least one of the cam and the cylinder block.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

Figure 1:
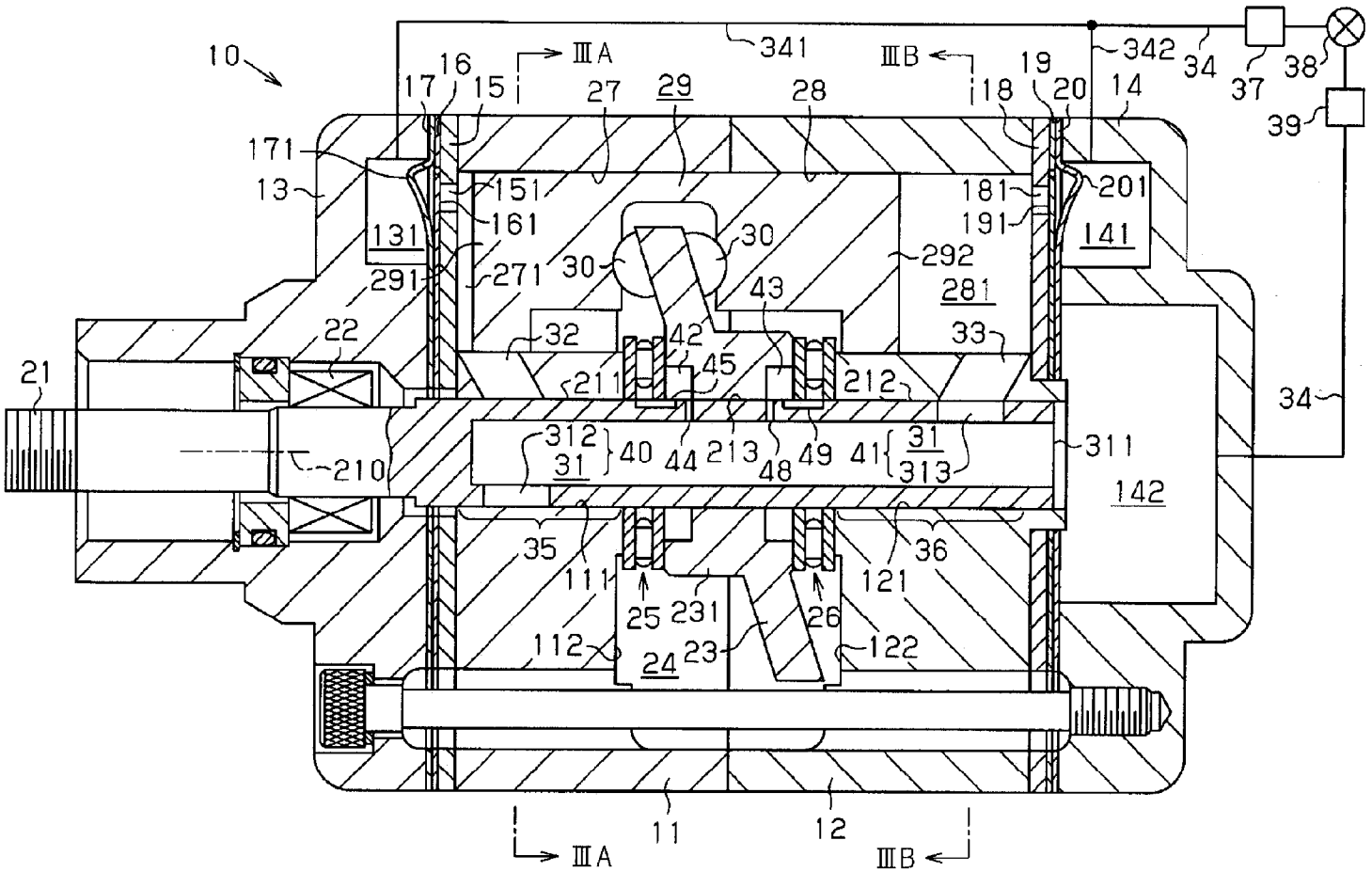
FIG. 1 is a longitudinal sectional view of a compressor according to a first embodiment of the present invention.

FIG. 1 shows a double-headed piston type compressor 10 according to the first embodiment of the present invention. It is noted that the left-hand side and the right-hand side as viewed in FIG. 1 are the front side and the rear side of the compressor 10, respectively. The compressor 10 has a pair of first and second cylinder blocks 11 and 12 that are connected to front and rear housings 13 and 14, respectively. The first cylinder block 11, the second cylinder block 12, the front housing 13 and the rear housing 14 cooperate to form a housing assembly of the compressor 10. The compressor 10 has discharge chambers 131 and 141 formed in the front and rear housings 13 and 14, respectively, and a suction chamber 142 formed in the rear housing 14. The suction chamber 142 serves as a suction-pressure region in the compressor 10.

The compressor 10 has a valve port plate 15, a valve plate 16 and a retainer plate 17 interposed between the first cylinder block 11 and the front housing 13. The compressor 10 further has a valve port plate 18, a valve plate 19 and a retainer plate 20 interposed between the second cylinder block 12 and the rear housing 14. The valve port plates 15 and 18 are formed with discharge ports 151 and 181, respectively. The valve plates 16 and 19 are formed with discharge valves 161 and 191 that normally close the discharge ports 151 and 181, respectively. The retainer plates 17 and 20 are formed with retainers 171 and 201 that regulate the opening of the discharge valves 161 and 191, respectively.

The first and second cylinder blocks 11 and 12 are formed therethrough with shaft holes 111 and 121, respectively, and a rotary shaft 21 is inserted through the shaft holes 111 and 121 and supported by the first and second cylinder blocks 11 and 12. The outer peripheral surface of the rotary shaft 21 is in contact with the inner peripheral surfaces of the shaft holes 111 and 121. The rotary shaft 21 is supported directly on the inner peripheral surfaces of the shaft holes 111 and 121 of the first and second cylinder blocks 11 and 12. The outer peripheral surface of the rotary shaft 21 has a sealing surface 211 that is in contact with the inner peripheral surface of the shaft hole 111 and a sealing surface 212 that is in contact with the inner peripheral surface of the shaft hole 121.

The compressor 10 has a swash plate 23 fixed to the rotary shaft 21 for rotation therewith and serving as a cam. The swash plate 23 is accommodated in a crank chamber 24 (cam chamber) that is formed by and between the first and second cylinder blocks 11 and 12. Leakage of refrigerant through the clearance between the front housing 13 and the rotary shaft 21 is prevented by a lip-type seal member 22 that is interposed between the front housing 13 and the rotary shaft 21. The front end of the rotary shaft 21 protruding out of the front housing 13 receives driving force from an external drive source such as a vehicle engine (not shown).

Figure 3A:
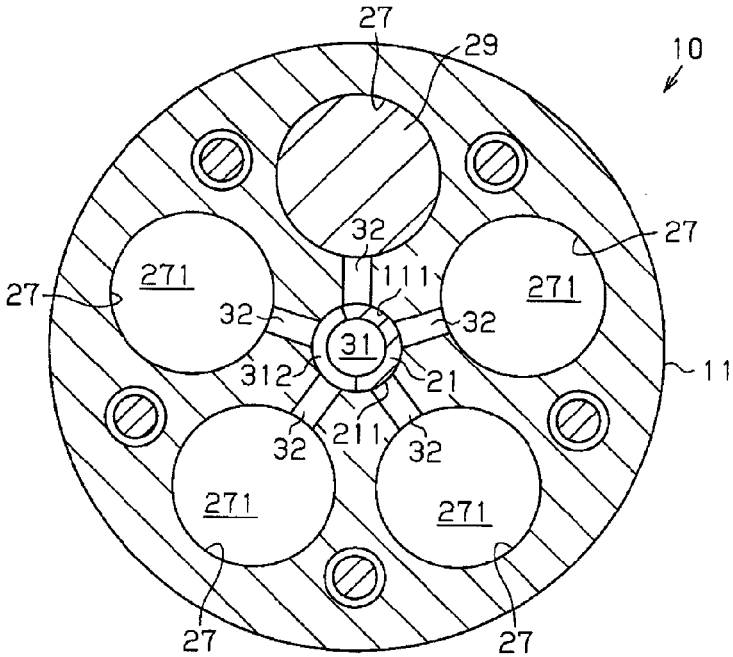
FIG. 3A is a cross-sectional view taken along the line IIIA-IIIA of FIG. 1.
Figure 3B:
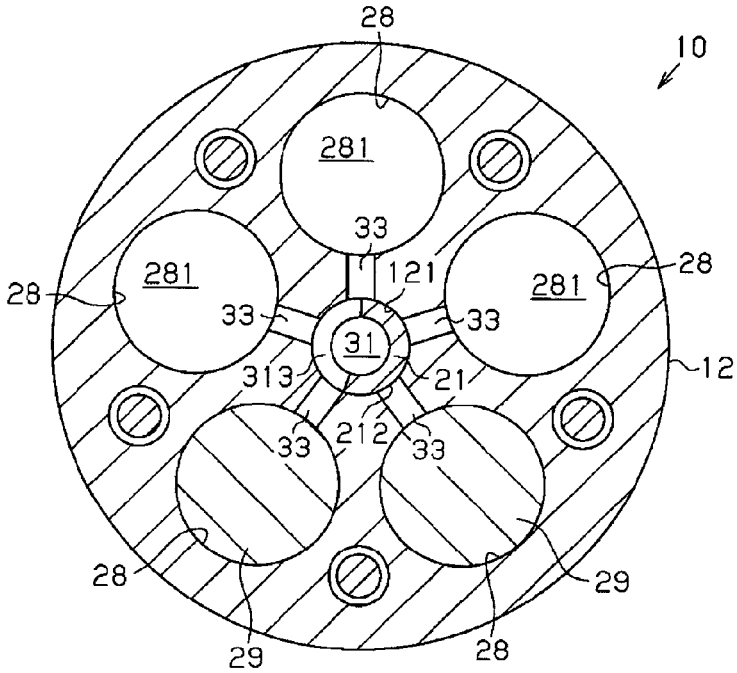
FIG. 3B is a cross-sectional view taken along the line IIIB-IIIB of FIG. 1.

Referring to FIGS. 3A and 3B, the first cylinder block 11 is formed with a plurality of first cylinder bores 27 arranged around the rotary shaft 21, and the second cylinder block 12 is formed similarly with a plurality of second cylinder bores 28 arranged around the rotary shaft 21. Each first cylinder bore 27 is paired with its opposite second cylinder bore 28 to accommodate therein a double-headed piston 29.

The rotating motion of the swash plate 23 rotating integrally with the rotary shaft 21 is transmitted to the double-headed piston 29 through a pair of shoes 30, so that the double-headed piston 29 reciprocates in its associated first and second cylinder bores 27 and 28. The double-headed piston 29 has cylindrical heads 291 and 292 on opposite ends thereof. The head 291 defines a first compression chamber 271 in the first cylinder bore 27, and the head 292 defines a second compression chamber 281 in the second cylinder bore 28.

The rotary shaft 21 is formed with an in-shaft passage 31 that extends along the rotational axis 210 of the rotary shaft 21. The in-shaft passage 31 has an inlet 311, a first outlet 312 and a second outlet 313. The in-shaft passage 31 is opened at the inlet 311 to the suction chamber 142 in the rear housing 14. The in-shaft passage 31 is opened at the first outlet 312 to the sealing surface 211 of the rotary shaft 21 in the shaft hole 111. The in-shaft passage 31 is opened at the second outlet 313 to sealing surface 212 of the rotary shaft 21 in the shaft hole 121.

Figure 2A:
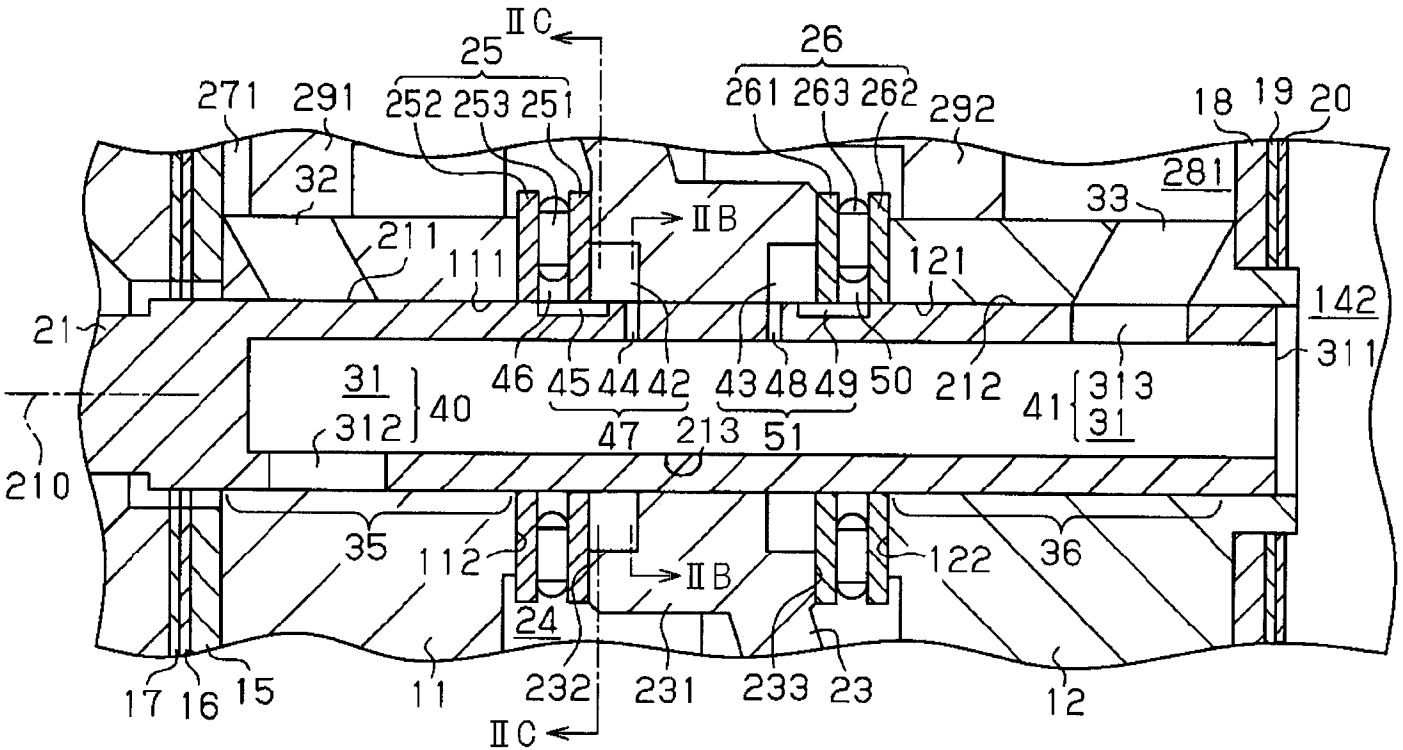
FIG. 2A is an enlarged fragmentary view of the compressor of FIG. 1.

As shown in FIGS. 2A and 3A, the first cylinder block 11 is formed with a plurality of first communication passages 32 that communicates with their associated first cylinder bores 27 and the shaft hole 111. As shown in FIGS. 2A and 3B, the second cylinder block 12 is formed with a plurality of second communication passages 33 that communicates with their associated second cylinder bore 28 and the shaft hole 121. As the rotary shaft 21 rotates, the first and second outlets 312 and 313 of the in-shaft passage 31 intermittently communicate with the first and second communication passages 32 and 33, respectively.

When the double-headed piston 29 is in the suction stroke for the first cylinder bore 27, that is, when the double-headed piston 29 is moving rightward in FIG. 1, the first outlet 312 is connected to the first communication passage 32. Refrigerant in the suction chamber 142 is introduced through the in-shaft passage 31, the first outlet 312 and the first communication passage 32 into the first compression chamber 271 in the first cylinder bore 27.

When the double-headed piston 29 is in the discharge stroke for the first cylinder bore 27, that is, when the double-headed piston 29 is moving leftward in FIG. 1, the first outlet 312 is disconnected from the first communication passage 32. Refrigerant in the first compression chamber 271 is discharged into the discharge chamber 131 thorough the discharge port 151 while pushing open the discharge valve 161. The refrigerant discharged into the discharge chamber 131 then flows into an external refrigerant circuit 34 through a passage 341.

When the double-headed piston 29 is in the suction stroke for the second cylinder bore 28, that is, when the double-headed piston 29 is moving leftward in FIG. 1, the second outlet 313 is connected to the second communication passage 33. Refrigerant in the suction chamber 142 is introduced through the in-shaft passage 31, the second outlet 313 and the second communication passage 33 into the second compression chamber 281 in the second cylinder bore 28.

When the double-headed piston 29 is in the discharge stroke for the second cylinder bore 28, that is, when the double-headed piston 29 is moving rightward in FIG. 1, the second outlet 313 is disconnected from the second communication passage 33. Refrigerant in the second compression chamber 281 is discharged into the discharge chamber 141 through the discharge port 181 while pushing open the discharge valve 191. The refrigerant discharged into the discharge chamber 141 then flows into the external refrigerant circuit 34 through a passage 342.

The external refrigerant circuit 34 includes a heat exchanger 37 for removing heat from refrigerant, an expansion valve 38, and a heat exchanger 39 for absorbing ambient heat. The expansion valve 38 controls the flow rate of refrigerant depending on the change of refrigerant temperature at the outlet of the heat exchanger 39. The refrigerant flowed through the external refrigerant circuit 34 then returns to the suction chamber 142 of the compressor 10. Lubricating oil is contained in and flows with refrigerant circulating through the compressor 10 and the external refrigerant circuit 34.

The sealing surface 211 of the rotary shaft 21 forms a first rotary valve 35, and the sealing surface 212 of the rotary shaft 21 forms a second rotary valve 36. The in-shaft passage 31 and the first outlet 312 form a first supply passage 40 for the first rotary valve 35, and the in-shaft passage 31 and the second outlet 313 form a second supply passage 41 for the second rotary valve 36.

As shown in FIG. 2A, a first thrust bearing 25 is disposed between a base 231 of the swash plate 23 and the first cylinder block 11 and a second thrust bearing 26 is disposed between the base 231 and the second cylinder block 12, respectively. The first and second thrust bearings 25 and 26 are provided on opposite sides of the base 231 of the swash plate 23 as seen in the axial direction of the rotary shaft 21. The first thrust bearing 25 has a ring-shaped race 251 (first race) in contact with the front end surface 232 of the base 231 of the swash plate 23, a ring-shaped race 252 (second race) in contact with the end surface 112 of the first cylinder block 11, and a plurality of rollers 253 (rolling elements) provided between the races 251 and 252. The rollers 253 are retained between the races 251 and 252 to form a gap 46 therebetween. As the swash plate 23 rotates, the rollers 253 roll while engaging with the races 251 and 252.

The second thrust bearing 26 has a ring-shaped race 261 (first race) in contact with the rear end surface 233 of the base 231 of the swash plate 23, a ring-shaped race 262 (second race) in contact with the end surface 122 of the second cylinder block 12, and a plurality of rollers 263 (rolling elements) provided between the races 261 and 262. The rollers 263 are retained between the races 261 and 262 to form a gap 50 therebetween. As the swash plate 23 rotates, the rollers 263 roll while engaging with the races 261 and 262.

The position of the swash plate 23 is restricted between the first and second cylinder blocks 11 and 12 by the first and second thrust bearings 25 and 26. The swash plate 23 has oil storage spaces 42 and 43 (oil retaining space) formed in the front and rear end surfaces 232 and 233 of the base 231, respectively.

Figure 2B:
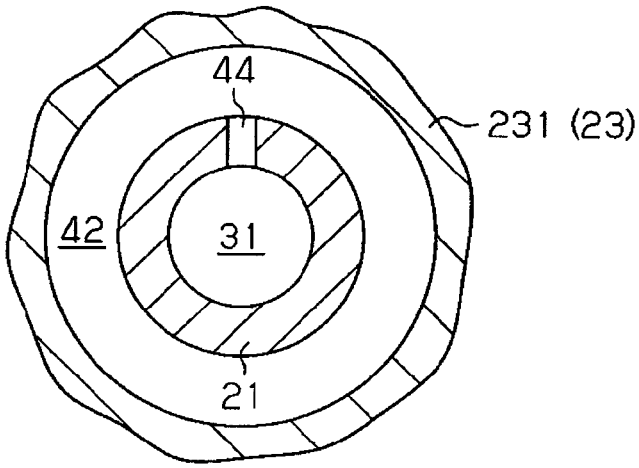
FIG. 2B is a cross-sectional view taken along the line IIB-IIB of FIG. 2A.
Figure 2C:
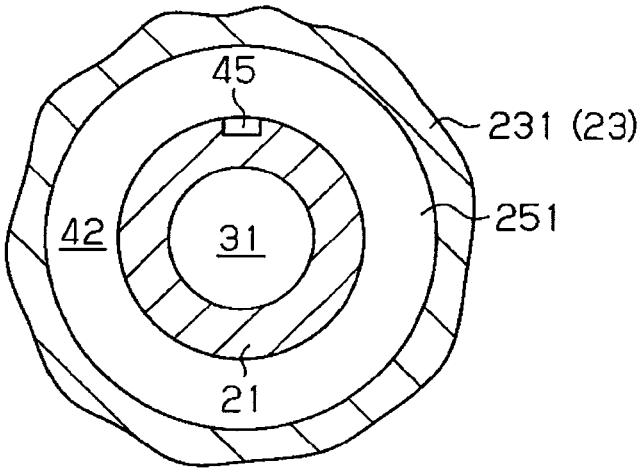
FIG. 2C is a cross-sectional view taken along the line IIC-IIC of FIG. 2A.

As shown in FIGS. 2A, 2B and 2C, the oil storage space 42 extend around the rotary shaft 21 thereby to form a ring shape, and part of the oil storage space 42 is formed by the outer peripheral surface 213 of the rotary shaft 21. Similarly, the oil storage space 43 extends around the rotary shaft 21 to form a ring shape, and part of the oil storage space 43 is formed by the outer peripheral surface 213 of the rotary shaft 21.

The rotary shaft 21 has a hole 44 (hole passage) formed in the part of the outer peripheral surface 213 that is adjacent to the oil storage space 42 and extending radially between the oil storage space 42 and the in-shaft passage 31 for fluid communication therebetween. The rotary shaft 21 has a groove 45 (groove passage) formed in the outer peripheral surface 213 for fluid communication between the oil storage space 42 and the gap 46 that is formed between the races 251 and 252 by the rollers 253. The gap 46 communicates with the in-shaft passage 31 through the groove 45, the oil storage space 42 and the hole 44. The groove 45, the oil storage space 42 and the hole 44 cooperate to form an oil passage 47 that extends from the gap 46 in the first thrust bearing 25 to the in-shaft passage 31. In the oil passage 47, the oil storage space 42 is the outermost portion as seen in radial direction of the rotary shaft 21, which is located radially outward of the groove 45 and the hole 44.

The rotary shaft 21 has a hole 48 (hole passage) formed in the part of the outer peripheral surface 213 that is adjacent to the oil storage space 43 and extending radially between the oil storage space 43 and the in-shaft passage 31 for fluid communication therebetween. The rotary shaft 21 has a groove 49 (groove passage) formed in the outer peripheral surface 213 for fluid communication between the oil storage space 43 and the gap 50 that is formed between the races 261 and 262 by the rollers 263. The gap 50 communicates with the in-shaft passage 31 through the groove 49, the oil storage space 43 and the hole 48. The groove 49, the oil storage space 43 and the hole 48 cooperate to form an oil passage 51 that extends from the gap 50 in the second thrust bearing 26 to the in-shaft passage 31. In the oil passage 51, the oil storage space 43 is the outermost portion as seen in radial direction of the rotary shaft 21, which is located radially outward of the groove 49 and the hole 48.

When the double-headed piston 29 is in the discharge stroke for the first cylinder bore 27, the pressure in the first compression chamber 271 defined by the head 291 is larger than suction pressure. Similarly, when the double-headed piston 29 is in the discharge stroke for the second cylinder bore 28, the pressure in the second compression chamber 281 defined by the head 292 is larger than suction pressure. Part of the refrigerant existing in the first and second compression chambers 271 and 281 flows into the crank chamber 24 through the clearance between the outer peripheral surfaces of the heads 291 and 292 of the double-headed piston 29 and the inner peripheral surfaces of the first and second cylinder bores 27 and 28. Therefore, the pressure in the crank chamber 24 is larger than that in the in-shaft passage 31 where the pressure is substantially the same as the suction pressure. Such pressure difference causes refrigerant in the crank chamber 24 to flow into the in-shaft passage 31 through the gap 46, the groove 45, the oil storage space 42 and the hole 44 and also through the gap 50, the groove 49, the oil storage space 43 and the hole 48.

The first thrust bearing 45 is lubricated by lubricating oil contained in refrigerant flowing through the gap 46, the groove 45, the oil storage space 42 and the hole 44. The second thrust bearing 46 is lubricated by lubricating oil contained in refrigerant flowing through the gap 50, the groove 49, the oil storage space 43 and the hole 48.

The groove 45 extends in the axial direction of the rotary shaft 21, and the hole 44 extends in the radial direction of the rotary shaft 21. The oil passage 47 formed by the groove 45, the oil storage space 42 and the hole 44 has bends, and part of the lubricating oil contained in the refrigerant flowing in such oil passage 47 is separated by virtue of such bends. Part of the lubricating oil separated in the oil passage 47 is stored in the oil storage space 42 by centrifugal force. Part of the lubricating oil stored in the oil storage space 42 is delivered through the groove 45 to the gap 46 in the first thrust bearing 25 thereby to lubricate the rollers 253.

The groove 49 extends in the axial direction of the rotary shaft 21, and the hole 48 extends in the radial direction of the rotary shaft 21. The oil passage 51 formed by the groove 49, the oil storage space 43 and the hole 48 has bends, and part of the lubricating oil contained in the refrigerant flowing in such oil passage 48 is separated. Part of the lubricating oil separated in the oil passage 51 is stored in the oil storage space 43 by centrifugal force. Part of the lubricating oil stored in the oil storage space 43 is delivered through the groove 49 to the gap 50 in the second thrust bearing 26 thereby to lubricate the rollers 263.

The compressor 10 according to the first embodiment offers the following advantages:

(1) Lubricating oil separated in the oil passages 47 and 51 is stored in the oil storage spaces 42 and 43 and used for lubricating the rollers 253 and 263 of the first and second thrust bearings 25 and 26, which allows efficient lubrication of the first and second thrust bearings 25 and 26.

(2) The whole part of the oil storage spaces 42 and 43 is the radially outermost portion in the oil passages 47 and 51, respectively. Therefore, lubricating oil separated in the oil passages 47 and 51 is delivered easily into the oil storage spaces 42 and 43 by centrifugal force.

(3) The provision of the oil storage spaces 42 and 43, part of which is formed by the outer peripheral surface 213 of the rotary shaft 21, minimize the distances between the oil storage spaces 42, 43 and the grooves 45, 49, as well as the distances between the oil storage spaces 42, 43 and the holes 44, 48, respectively. In this case, the compressor 10 requires no additional passage for connecting the oil storage spaces 42 and 43 to the grooves 45 and 49 and for connecting the oil storage spaces 42 and 43 and the holes 44 and 48. Thus, it is advantageous that part of the oil storage spaces 42 and 43 is formed by the outer peripheral surface 231 of the rotary shaft 21.

(4) The oil passage 47 including the axially extending groove 45 and the radially extending hole 44 has bends, and the oil passage 51 including the axially extending groove 49 and the radially extending hole 48 has bends. The bends in the oil passages 47 and 51 help to separate lubricating oil efficiently from refrigerant.

(5) When the races 251 and 261 of the first and second thrust bearings 25 and 26 are rotated with the rotation of the swash plate 23, the races 251 and 261 may be rotated relative to the front and rear end surfaces 232 and 233 of the base 231 of the swash plate 23. In this case, the races 251 and 261 should slide smoothly on their associated front and rear end surfaces 232 and 233 of the swash plate 23 in order to prevent abrasion. In the first embodiment wherein the oil storage spaces 42 and 43 are formed in the front and rear end surfaces 232 and 233 of the base 231 of the swash plate 23, respectively, the sliding surfaces between the race 251 and the front end surface 232 and between the race 261 and the rear end surfaces 233 are efficiently lubricated. This allows the races 251 and 261 to slide smoothly on their associated front and rear end surfaces 232 and 233 of the base 231 of the swash plate 23.

(6) The oil passages 47 and 51 are provided for the first and second thrust bearings 25 and 26, respectively, so that the first and second thrust bearings 25 and 26 are evenly lubricated.

Figure 4:
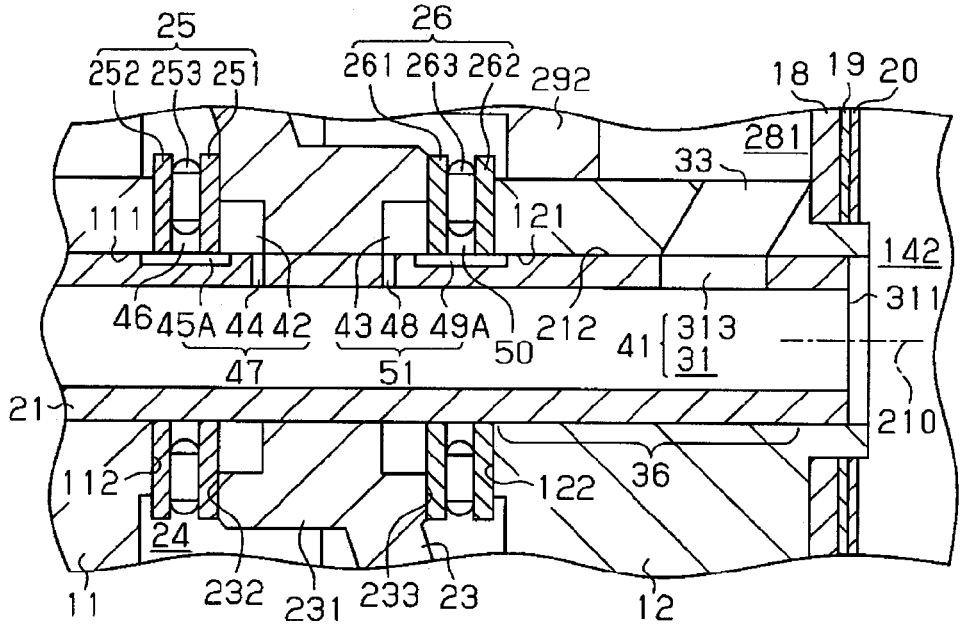
FIG. 4 is a fragmentary sectional view of a compressor according to a second embodiment of the present invention.

FIG. 4 shows the second embodiment of the present invention. In FIG. 4, same reference numerals are used for the common elements or components in the first and second embodiments, and the description of such elements or components for the second embodiment will be omitted.

In the second embodiment, the groove 45A extends axially beyond the first thrust bearing 25 to the clearance between the race 252 and the end surface 112 of the first cylinder block 11, and the groove 49A extends axially beyond the second thrust bearing 26 to the clearance between the race 262 and the end surface 122 of the second cylinder block 12.

When the swash plate 23 is rotated, the races 252 and 262 of the first and second thrust bearings 25 and 26 may be rotated relative to the end surfaces 112 and 122 of the first and second cylinder blocks 11 and 12. In this case, the races 252 and 262 should slide smoothly on their associated end surfaces 112 and 122 to prevent abrasion.

In the second embodiment, since the groove 45A and 49A are formed so as to extend to the clearance between the race 252 and the end surface 112 and between the race 262 and the end surface 122, the sliding surfaces between the race 252 and the end surface 112 and between the race 262 and the end surface 122 are efficiently lubricated. This allows the races 252 and 262 to slide smoothly on their associated end surfaces 112 and 122 of the first and second cylinder blocks 11 and 12.

Figure 5:
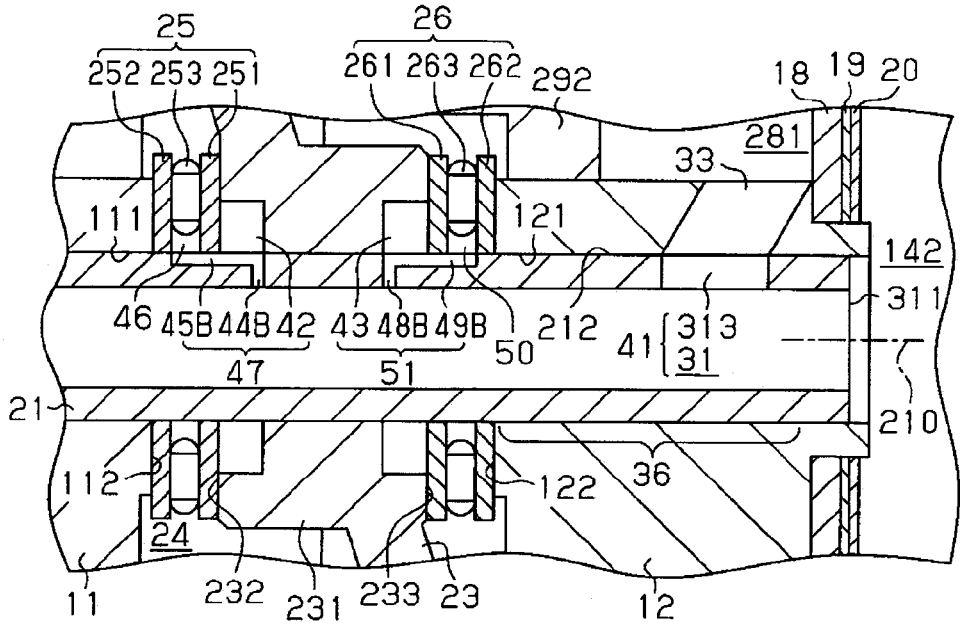
FIG. 5 is a fragmentary sectional view of a compressor according to a third embodiment of the present invention.

FIG. 5 shows the third embodiment of the present invention. In FIG. 5, same reference numerals are used for the common elements or components in the first and third embodiments, and the description of such elements or components for the third embodiment will be omitted.

In the third embodiment, the groove 45B directly communicates with the hole 44B, and the groove 49B directly communicates with the hole 48B. The third embodiment offers the advantages similar to those of the first embodiment.

Figure 6A:
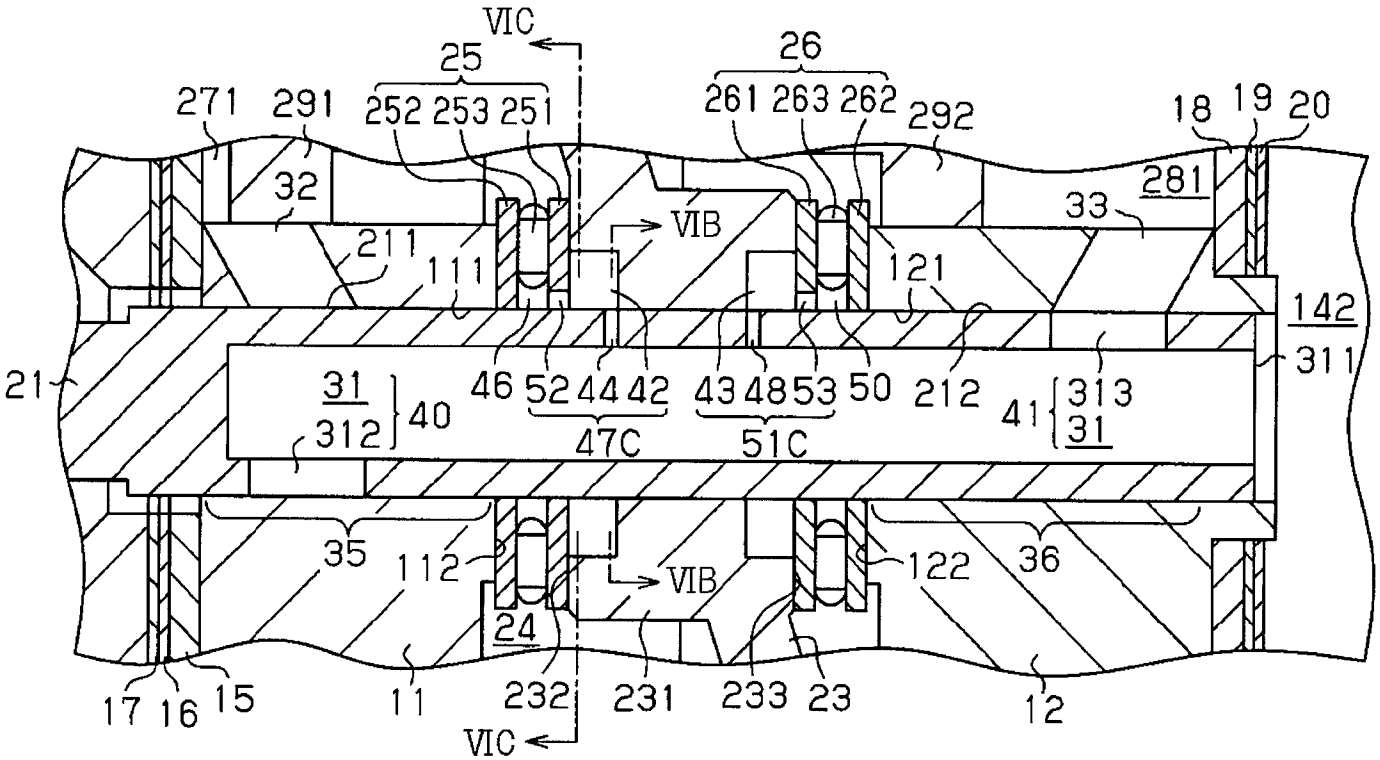
FIG. 6A is a fragmentary sectional view of a compressor according to a fourth embodiment of the present invention.
Figure 6B:
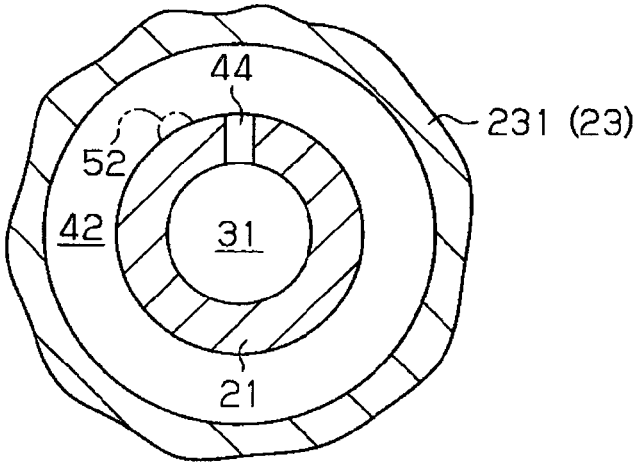
FIG. 6B is a cross-sectional view taken along the line VIB-VIB of FIG. 6A.
Figure 6C:
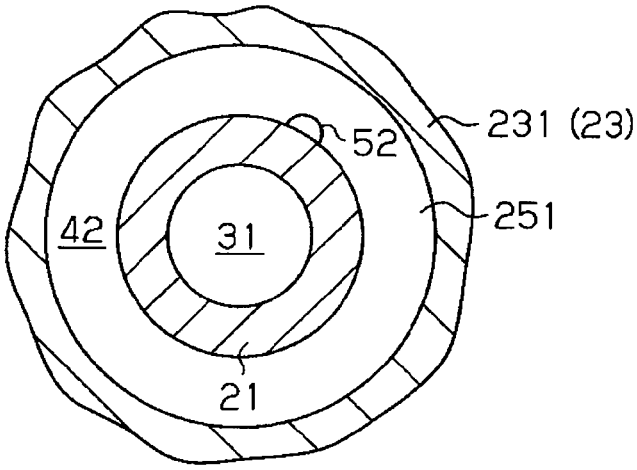
FIG. 6C is a cross-sectional view taken along the line VIC-VIC of FIG. 6A.

FIGS. 6A, 6B and 6C show the fourth embodiment of the present invention. In the drawings, same reference numerals are used for the common elements or components in the first and fourth embodiments, and the description of such elements or components for the fourth embodiment will be omitted.

In the fourth embodiment, the ring-shaped race 251 of the first thrust bearing 25 has a race groove 52 formed in the inner peripheral surface thereof, and the ring-shaped race 261 of the second thrust bearing 26 has a race groove 53 formed in the inner peripheral surface thereof. The race grooves 52 and 53 extend through the races 251 and 261, respectively, along the rotational axis 210 of the rotary shaft 21. The race groove 52 connects the gap 46 to the oil storage space 42, and the race groove 53 connects the gap 50 to the oil storage space 43. The race groove 52, the oil storage space 42 and the hole 44 form an oil passage 47C. The race groove 53, the oil storage space 43 and the hole 48 form an oil passage 51C.

Forming the oil storage spaces 42 and 43 in a ring shape, fluid communication between the race groove 52 of the race 251 and the oil storage space 42 and also between the race groove 53 of the race 261 and the oil storage space 43 is maintained while the races 251 and 261 are rotated relative to the base 231 of the swash plate 23.

Figure 7A:
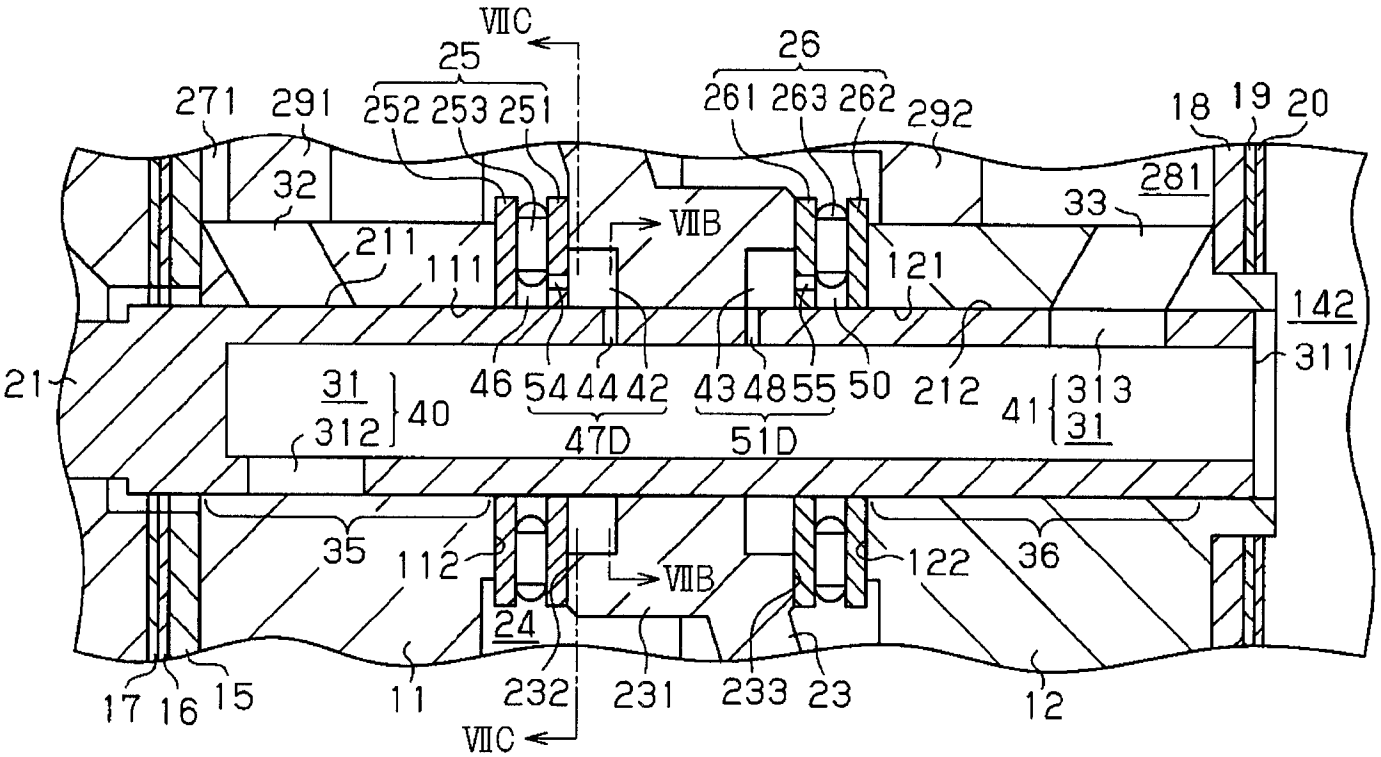
FIG. 7A is a fragmentary sectional view of a compressor according to a fifth embodiment of the present invention.
Figure 7B:
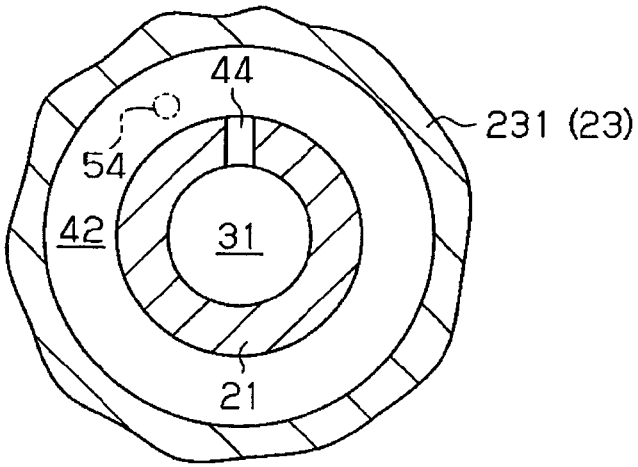
FIG. 7B is a cross-sectional view taken along the line VIIB-VIIB of FIG. 7A.
Figure 7C:
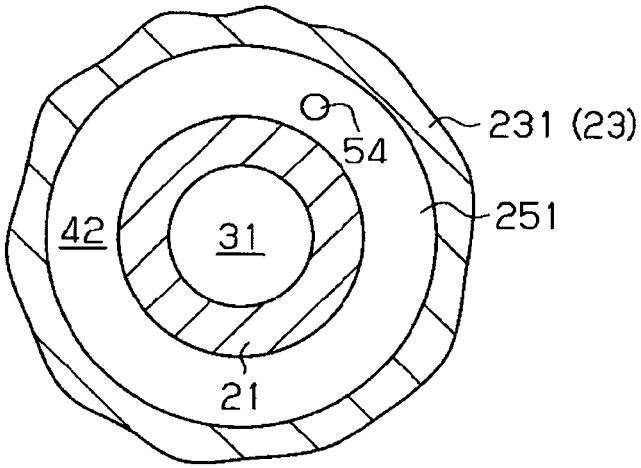
FIG. 7C is a cross-sectional view taken along the line VIIC-VIIC of FIG. 7A.

The race grooves 52 and 53 may be formed easily in the races 251 and 261 simply by die forming, as compared to the case where the groove is formed in the outer peripheral surface of the rotary shaft 21 by machining FIGS. 7A, 7B and 7C show the fifth embodiment of the present invention. In these drawings, same reference numerals are used for the common elements or components in the first and fifth embodiments, and the description of such elements or components for the fifth embodiment will be omitted.

In the fifth embodiment, the ring-shaped race 251 has a race hole 54 formed therethrough for connecting the gap 46 to the oil storage space 42, and the ring-shaped race 261 has a race hole 55 formed therethrough for connecting the gap 50 to the oil storage space 43. The race hole 54, the oil storage space 42 and the hole 44 form an oil passage 47D. The race hole 55, the oil storage space 43 and the hole 48 form an oil passage 51D.

Forming the oil storage spaces 42 and 43 in a ring shape, fluid communication between the race hole 54 of the race 251 and the oil storage space 42 and also between the race hole 55 of the race 261 and the oil storage space 43 is maintained while the races 251 and 261 are rotated relative to the base 231 of the swash plate 23.

The race holes 54 and 55 may be formed easily in the races 251 and 261 simply by die forming, as compared to the case where the groove is formed in the outer peripheral surface of the rotary shaft 21 by machining The parts of the oil storages spaces 42 and 43 which are located radially outward of the race holes 54 and 55 are the radially outermost portions in the oil passages 47D and 51D, respectively. Therefore, lubricating oil existing in the oil passages 47D and 51D is delivered into the oil storage spaces 42 and 43 by centrifugal force.

Figure 8:
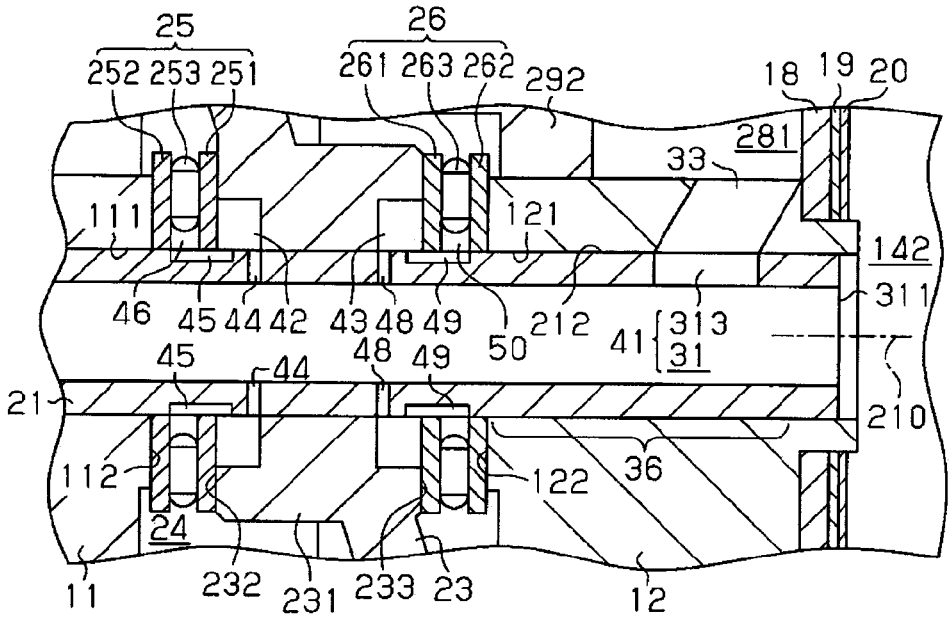
FIG. 8 is a fragmentary sectional view of a compressor according to a sixth embodiment of the present invention.

FIG. 8 shows the sixth embodiment of the present invention. In FIG. 8, same reference numerals are used for the common elements or components in the first and sixth embodiments, and the description of such elements or components for the sixth embodiment will be omitted.

In the sixth embodiment, the rotary shaft 21 has plural grooves 45, plural holes 44, plural grooves 49 and plural holes 48 formed in the outer peripheral surface thereof. Each of the grooves 45 and holes 44 communicates with the oil storage space 42. Each of the grooves 49 and holes 48 communicates with the oil storage space 43.

Figure 9:
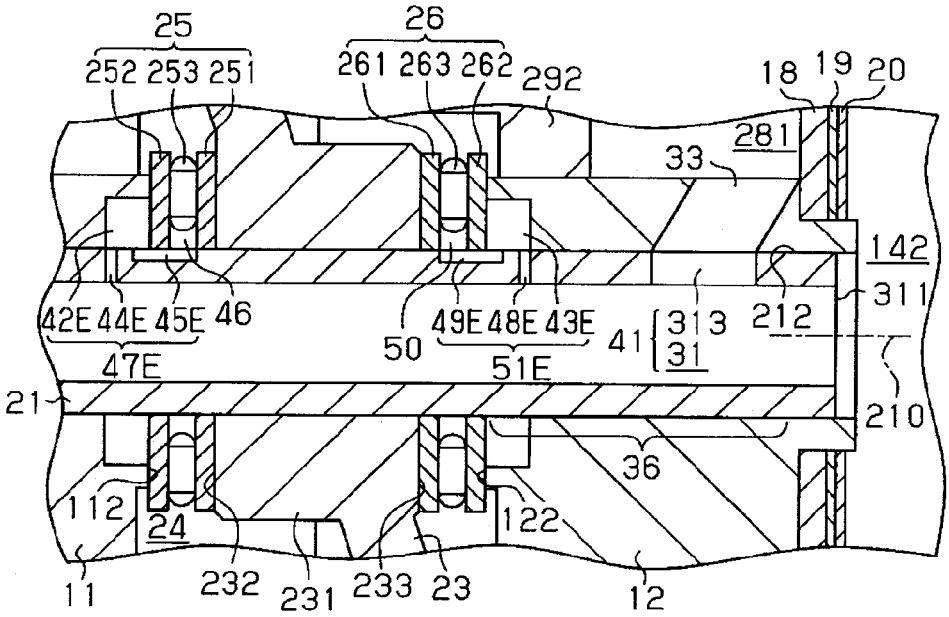
FIG. 9 is a fragmentary sectional view of a compressor according to a seventh embodiment of the present invention.

FIG. 9 shows the seventh embodiment of the present invention. In FIG. 9, same reference numerals are used for the common elements or components in the first and seventh embodiments, and the description of such elements or components for the seventh embodiment will be omitted.

In the seventh embodiment, the first cylinder block 11 has an oil storage space 42E formed in the end surface 112 thereof, and the second cylinder block 12 has an oil storage space 43E formed in the end surface 122 thereof The oil storage space 42E extends around the rotary shaft 21 to form a ring shape, so that part of the oil storage space 42E is formed by the outer peripheral surface 213 of the rotary shaft 21. Similarly, the oil storage space 43E extends around the rotary shaft 21 to form a ring shape, so that part of the oil storage space 43E is formed by the outer peripheral surface 213 of the rotary shaft 21.

The rotary shaft 21 has a hole 44E formed in the part of the outer peripheral surface 213 of the rotary shaft 21 adjacent to the oil storage space 42E and extending to the in-shaft passage 31 for fluid communication between the oil storage space 42E and the in-shaft passage 31. The rotary shaft 21 has a groove 45E formed in the outer peripheral surface 213 for fluid communication between the oil storage space 42E and the gap 46 that is formed between the races 251 and 252 of the first thrust bearing 25. The groove 45E, the oil storage space 42E and the hole 44E form an oil passage 47E that extends from the gap 46 to the in-shaft passage 31.

The rotary shaft 21 has a hole 48E formed in the part of the outer peripheral surface 213 of the rotary shaft 21 adjacent to the oil storage space 43E and extending to the in-shaft passage 31 for fluid communication between the oil storage space 43E and the in-shaft passage 31. The rotary shaft 21 has a groove 49E formed in the outer peripheral surface 213 for fluid communication between the oil storage space 43E and the gap 50 that is formed between the races 261 and 262 of the second thrust bearing 26. The groove 49E, the oil storage space 43E and the hole 48E form an oil passage 51E that extends from the gap 50 to the in-shaft passage 31.

When the swash plate 23 is rotated, the races 252 and 262 of the first and second thrust bearings 25 and 26 may be rotated relative to the end surfaces 112 and 122 of the first and second cylinder blocks 11 and 12. In this case, the races 252 and 262 should slide smoothly on their associated end surfaces 112 and 122 in order to prevent abrasion.

In the seventh embodiment, the provision of the oil storage spaces 42E and 43E which are formed in the end surfaces 112 and 122 of the first and second cylinder blocks 11 and 12 permit efficient lubrication of the sliding surfaces between the race 252 and the end surface 112 and also between the race 262 and the end surface 122. This allows the races 252 and 262 to slide smoothly on their associated end surfaces 112 and 122 of the first and second cylinder blocks 11 and 12. Additionally, the seventh embodiment offers the advantages similar to those of the first embodiment.

The above embodiments may be modified in various ways as exemplified below.

The front housing 13 may be formed with a suction chamber from which refrigerant is introduced into the in-shaft passage 31.

The present invention may be applied to a piston type compressor using a single-headed piston.

The first and second rotary valves 35 and 36 may be provided separately from the rotary shaft 21.

What is claimed is:

1. A piston compressor, comprising:

a rotary shaft having an in-shaft passage formed therein;

a cam rotating integrally with the rotary shaft and accommodated in a cam chamber, wherein the pressure in the cam chamber is larger than the pressure in the in-shaft passage;

a cylinder block having a plurality of cylinder bores located around the rotary shaft;

pistons accommodated in the respective cylinder bores to form therein compression chambers, the pistons being coupled to the rotary shaft through the cam so that rotating motion of the rotary shaft is transmitted to the pistons;

a thrust bearing provided between the cam and the cylinder block, the thrust bearing including a first race in contact with the cam, a second race in contact with the cylinder block, and rolling elements retained between the first and second races to form a gap therebetween;

a rotary valve for introducing refrigerant into the compression chambers, the rotary valve including the in-shaft passage of the rotary shaft, the refrigerant being introduced into the compressor and then delivered through the in-shaft passage to the compression chambers without passing through the cam chamber; and an oil passage extending from the gap to the in-shaft passage, wherein the oil passage includes an oil retaining space formed in at least one of the cam and the cylinder block, the oil retaining space being provided downstream of the gap as viewed in the direction of refrigerant flow, wherein one of the first and second races forms part of the oil retaining space, wherein the oil passage includes a groove passage and a hole passage, the groove passage is formed in an outer peripheral surface of the rotary shaft and extends across the one of the first and second races so as to connect from the gap to the oil retaining space, and the hole passage is formed in the rotary shaft so as to connect from the oil retaining space to the in-shaft passage, and wherein the oil retaining space is located outward of the groove passage and the hole passage as seen in radial direction of the rotary shaft.

2. The piston compressor according to claim 1, wherein at least part of the oil retaining space is the outermost portion in the oil passage as seen in the radial direction of the rotary shaft.

3. The piston compressor according to claim 2, wherein part of the oil retaining space is defined by an outer peripheral surface of the rotary shaft.

4. The piston compressor according to claim 1, wherein the groove passage extends in the axial direction of the rotary shaft, and the hole passage extends in the radial direction of the rotary shaft.

5. The piston compressor according to claim 1, wherein the oil retaining space is formed in an end surface of the cam in contact with the first race of the thrust bearing.

6. The piston compressor according to claim 1, wherein the piston is of a double-headed type and accommodated in the cylinder bore to form therein a first compression chamber and a second compression chamber, the rotary valve is provided by a first rotary valve for introducing refrigerant into the first compression chamber and a second rotary valve for introducing refrigerant into the second compression chamber, the first and second rotary valves include the in-shaft passage of the rotary shaft, the refrigerant being introduced into the compressor and then delivered through the in-shaft passage to the first and second compression chambers without passing through the cam chamber, two thrust bearings are provided on opposite sides of the cam as seen in the axial direction of the rotary shaft, and two oil passages are provided for the respective thrust bearings.

7. The piston compressor according to claim 1, wherein the oil retaining space extends around the rotary shaft thereby to form a ring shape.

* * * * *